US010273963B2

(12) United States Patent
Santucci

(10) Patent No.: US 10,273,963 B2
(45) Date of Patent: Apr. 30, 2019

(54) EXTRACTION HOOD

(71) Applicant: Whirlpool EMEA S.p.A., Pero (IT)

(72) Inventor: Mauro Santucci, Fabriano (IT)

(73) Assignee: Whirlpool EMEA S.p.A., Pero (IT)

( * ) Notice: Subject to any disclaimer, the term of this patent is extended or adjusted under 35 U.S.C. 154(b) by 494 days.

(21) Appl. No.: 14/972,632

(22) Filed: Dec. 17, 2015

(65) Prior Publication Data

US 2016/0177957 A1 Jun. 23, 2016

(30) Foreign Application Priority Data

Dec. 22, 2014 (IT) ..... TO2014A1086

(51) Int. Cl.
*F04D 25/06* (2006.01)
*F04D 29/42* (2006.01)
(Continued)

(52) U.S. Cl.
CPC ..... *F04D 25/0693* (2013.01); *F04D 25/08* (2013.01); *F04D 29/281* (2013.01);
(Continued)

(58) Field of Classification Search
CPC .... F04D 25/0693; F04D 25/08; F04D 29/281; F04D 29/4226; F04D 29/4233;
(Continued)

(56) References Cited

U.S. PATENT DOCUMENTS 2,895,666 A * 7/1959 Girdwood ..... F04D 25/064 29/889.4
2,971,451 A * 2/1961 Feig ..... F24C 15/20 126/299 D
3,300,122 A * 1/1967 Bowles ..... F04D 25/086 290/52
3,563,004 A * 2/1971 Schouw ..... B01D 45/14 261/116
(Continued)

FOREIGN PATENT DOCUMENTS

EP 0 985 829 A2 3/2000
EP 1 094 224 A2 4/2001
EP 1094224 * 4/2001 ..... F04D 25/08
EP 1094224 A2 * 4/2001 ..... F04D 25/08

OTHER PUBLICATIONS

Italian Search Report dated Sep. 1, 2015 for Italian Application No. TO2014A001086 filed on Dec. 22, 2014, 6 pages.

*Primary Examiner* — Devon C Kramer
*Assistant Examiner* — Benjamin C Doyle
(74) *Attorney, Agent, or Firm* — Cesari and McKenna, LLP

(57) ABSTRACT

The present invention relates to a suction device (103) for a hood, comprising an impeller (303), an electric motor (302) that drives said impeller (303), a volute (201) that houses inside the electric motor (302) and the impeller (303), a capacitor (306), and a connector (307) electrically connected to the capacitor (306) for supplying power to the electric motor (302); the volute (201) comprises a first semi-shell
(Continued)

(201*a*) and a second semi-shell (201*b*) joined with each other so as to constitute the structure of the volute (201) surrounding the impeller (303); the capacitor (306) is housed in a first compartment (308) formed in the first semi-shell (201*a*), and the connector (307) is housed in a second compartment (309) formed in the second semi-shell (201*b*); the first compartment (308) and the second compartment (309) are adjacent to each other in the volute (201).
The present invention further relates to an associated range hood.

20 Claims, 3 Drawing Sheets

(51) Int. Cl.
*F04D 29/62* (2006.01)
*F04D 29/28* (2006.01)
*F04D 25/08* (2006.01)
*F24C 15/20* (2006.01)

(52) U.S. Cl.
CPC ..... *F04D 29/4226* (2013.01); *F04D 29/4233* (2013.01); *F04D 29/624* (2013.01); *F24C 15/20* (2013.01)

(58) Field of Classification Search
CPC ..... F04D 29/624; F04D 17/10; F04D 29/283; F04D 29/424; F24C 15/20
USPC ..... 417/411
See application file for complete search history.

(56) References Cited

U.S. PATENT DOCUMENTS 5,141,397 A * 8/1992 Sullivan ..... F04D 29/4233 285/319
5,474,422 A * 12/1995 Sullivan ..... F04D 29/4233 415/182.1
5,997,246 A * 12/1999 Humbad ..... F04D 29/667 415/119
6,223,741 B1 * 5/2001 Panos ..... F24C 15/20 126/299 E
6,386,123 B1 * 5/2002 Gatley, Jr. ..... F04D 29/4226 110/162
6,511,288 B1 * 1/2003 Gatley, Jr. ..... F04D 29/4226 415/206
7,861,708 B1 * 1/2011 Lyons ..... F04D 29/668 126/104 A
2006/0051205 A1 * 3/2006 Platz ..... F04D 29/4233 415/206
2010/0254826 A1 * 10/2010 Streng ..... F04D 25/06 417/44.1
2013/0189134 A1 * 7/2013 Irie ..... F04D 13/06 417/423.7
2014/0065945 A1 * 3/2014 Zakula ..... F04D 25/0606 454/322
2015/0157818 A1 * 6/2015 Darby ..... A61M 16/024 128/201.13
2016/0177957 A1 * 6/2016 Santucci ..... F04D 25/0693 417/411

* cited by examiner

EXTRACTION HOOD

CROSS REFERENCE TO RELATED APPLICATIONS

This application claims priority to Italian Application No. TO2014A001086, filed on Dec. 22, 2014, the content of which is hereby incorporated by reference in its entirety.

TECHNICAL FIELD

The present invention relates to the field of hoods, in particular for treating fumes and odours in household environments, e.g. range hoods.

The invention relates in particular to a suction device for a hood, as well as to an associated range hood.

PRIOR ART

Aspirating and/or filtering devices are known which are to be installed near places where fumes or odours are generated. For example, such aspirating and/or filtering devices are called "hoods" and are typically installed in household environments such as kitchens, over burners or cookers or generic heating elements whereon food is cooked.

Some hoods take in fumes from the environment, discharging the aspirated air into a ventilation duct, which then evacuates both fumes and odours out in the open; such hoods are hence referred to as "extraction hoods".

Other hoods collect fumes from the environment, filter them, and then reintroduce the air thus purified into the same environment; hoods of this latter type are referred to as "recirculating hoods".

The hoods known in the art comprise one or more suction devices, typically consisting of a compressor or a fan, wherein an electric motor drives an impeller, which provides an air volume with a certain head, thereby increasing its pressure for moving it within a duct. Known hoods comprise an air inlet opening connected to a chimney-type extraction element, and between the opening and the extraction element the suction device is inserted, which ensures proper operation of the hood.

Therefore, for the hood to aspirate air, the hoods known in the art require an electric motor for driving the impeller of the suction device.

For its part, said electric motor requires an appropriate power supply from an electric line; typically, the electric elements associated with electric motors installed in suction devices also comprise connectors and capacitors.

Such connectors and capacitors, which are needed for properly supplying power to the electric motors, are typically housed inside the suction devices.

The suction devices known in the art that comprise an electric motor suffer from a number of problems related to the arrangement of these electric elements, such as capacitors and connectors.

In fact, in some known suction devices, said electric elements are inserted in the volute, in particular under the electric motor.

In general, the arrangement of said electric elements, such as capacitors and connectors, in the suction devices known in the art results in poor fluid-dynamic performance of the devices themselves, due to the disturbance caused by the air flow taken in by the impeller.

OBJECTS AND SUMMARY OF THE INVENTION

It is the object of the present invention to overcome some of the problems of the prior art.

In particular, it is one object of the present invention to provide a suction device which is alternative to those according to the prior art.

It is another object of the present invention to provide a suction device wherein capacitors and connectors are housed in a position that will not hinder the air flow taken in by the impeller.

It is another object of the present invention to provide a suction device which can be assembled more easily and manufactured more rationally.

It is a further object of the present invention to provide a suction device wherein capacitors and connectors are housed in a perfectly safe manner, so as to avoid any risk for the user.

These and other objects of the present invention are achieved through a suction device and an associated hood incorporating the features set out in the appended claims, which are intended to be an integral part of the present description.

A basic idea of the present invention is to provide a suction device for a hood, comprising an impeller, an electric motor that drives the impeller, a volute that houses inside the electric motor and the impeller, a capacitor, and a connector electrically connected to the capacitor for supplying power to the motor; the volute comprises a first semi-shell and a second semi-shell joined with each other so as to constitute the structure of the volute surrounding the impeller, and the capacitor is housed in a first compartment formed in the first semi-shell, while the connector is housed in a second compartment formed in the second semi-shell, wherein the first compartment and the second compartment are adjacent to each other in the volute.

This solution allows realizing a suction device wherein the electric elements, such as the capacitor and its connector, are housed in dedicated compartments, which are advantageously integrated into the semi-shells that constitute the volute. Such an arrangement turns out to be both rational and effective.

Preferably, the first compartment and the second compartment are located externally to the volute, with respect to the impeller. Thus, the capacitor and its connector are located in a region where they cannot disturb the air flow created by the impeller within the volute.

Preferably, the suction device further comprises an outflow collar for letting out the air, and the first compartment and the second compartment are located proximal to the outflow collar, above the electric motor. Thus, the capacitor and its connector are located in a region where they cannot disturb the air flow taken in by the impeller outside the volute.

This allows realizing a suction device offering fully satisfactory fluid-dynamic performance.

Preferably, the second compartment comprises two apertures in the second semi-shell, and the first compartment comprises only one aperture in the first semi-shell; one aperture of the first compartment faces a respective aperture of the second compartment when the two semi-shells are joined with each other, so as to constitute a common casing for the connector and the capacitor. Thus, the two joined semi-shells form a rational, strong and structurally efficient volute of the suction device.

Preferably, the connector is inserted into its housing through another aperture between the two apertures of the second semi-shell, which is still accessible when the semi-shells are joined with each other. In this way, it is possible to mount the connector even when the volute has already been assembled and the structure of the suction device is already closed.

Preferably, on the other hand, the capacitor is inserted through the single aperture of the first semi-shell when the first semi-shell and the second semi-shell have not yet been joined together. This allows mounting the capacitor before assembling the volute, so that it will be placed in a protected and insulated position, thereby improving the electric safety of the suction device and preventing the user from accidentally coming in contact with the capacitor.

Preferably, both semi-shells are made by moulding of a light and strong plastic material.

Preferably, the first compartment and the second compartment are formed in one piece in the respective semi-shells, thus further reducing the complexity of the production process and improving the rationality and effectiveness of the structure of the suction device.

Preferably, the connector is configured to be electrically connected to the capacitor by engaging directly with it, when both are inserted in the second compartment and first compartment, respectively.

The present invention also relates to an associated range hood in which the above-summarized suction device is installed.

Further objects and advantages of the present invention will become more apparent from the following detailed description and from the annexed drawings.

BRIEF DESCRIPTION OF THE DRAWINGS

Some preferred and advantageous embodiments will now be described by way of non-limiting example with reference to the annexed drawings, wherein.

The drawings show different aspects and embodiments of the present invention and, where appropriate, similar structures, components, materials and/or elements in the various drawings are designated by the same reference numerals.

DETAILED DESCRIPTION OF THE INVENTION

Figure 1:
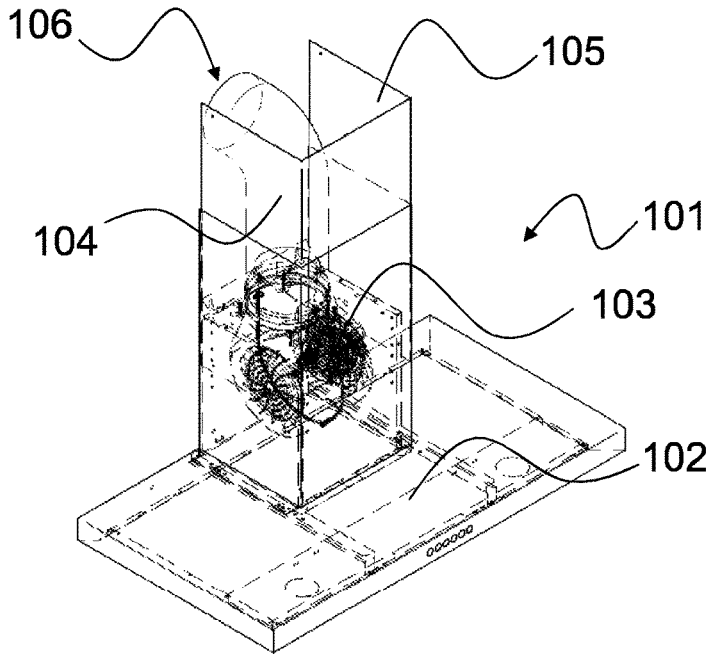
FIG. 1 exemplifies a hood according to the present invention.

FIG. 1 shows one example of a range hood 101 of the extraction type, preferably wall-mounted. In alternative embodiments, the range hood may be, for example, of the "island" type, i.e. installed away from the walls of the room and accessible on all four sides.

The hood 101 comprises a fume collector 102, which is typically positioned above a cooking top; the fume collector 102 may comprise further filter elements (not shown) for filtering airborne greasy particles, consisting of filters in accordance with the teachings of the prior art.

The hood 101 further comprises a suction device 103, adapted to collect air from the fume collector 102 and direct it into the extraction tube 104, as will be described more in detail below.

Preferably, the extraction tube 104 is masked by the aesthetic cover 105, which hides it from view to any users in the room where the hood 101 is located.

At the outlet of the extraction tube 104, i.e. at the top of the hood 101, there is a discharge section 106, such as a wall-mounted flange, which is typically available in the wall of the household environment where the hood 101 is installed.

In general, the present invention is applicable to any type of hood (whether of the extraction or recirculating type) or suction system that includes a suction device, as will be described below.

Figure 2:
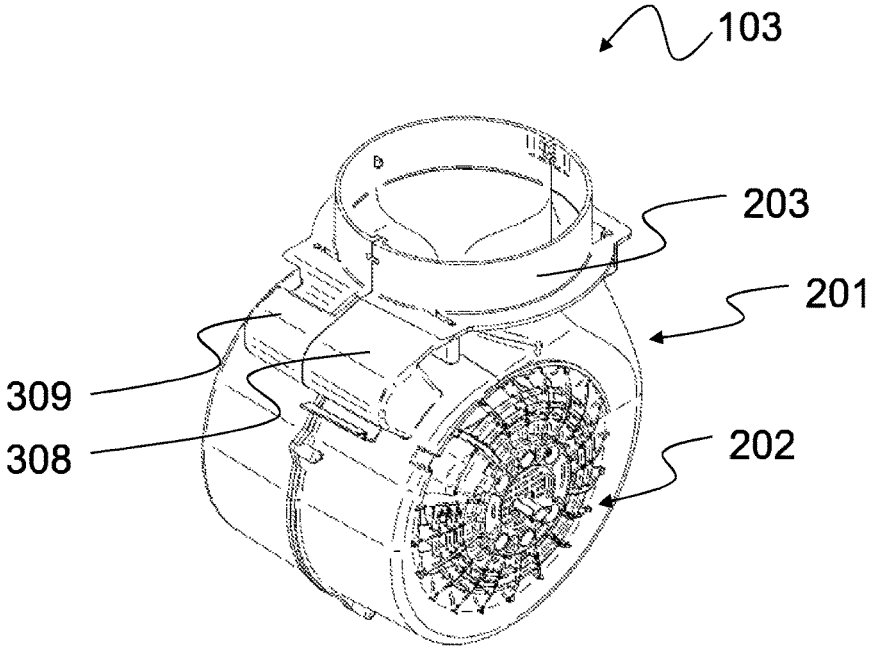
FIG. 2 shows a suction device for a hood according to the present invention.

FIG. 2 illustrates in more detail the suction device 103.

The suction device 103 comprises a volute 201, which houses inside an electric motor and an impeller driven by the electric motor.

The suction device 103 is configured to take in an air flow from at least one grid 202 and direct it into the outflow collar 203.

The outflow collar 203 is configured to be put in fluidic connection with the extraction tube 104 of the hood 101, while the grid 202 takes in the air coming from the fume collector 102. The outflow collar (or flange) is typically vertical and directly connected to the extraction tube 104.

Figure 3:
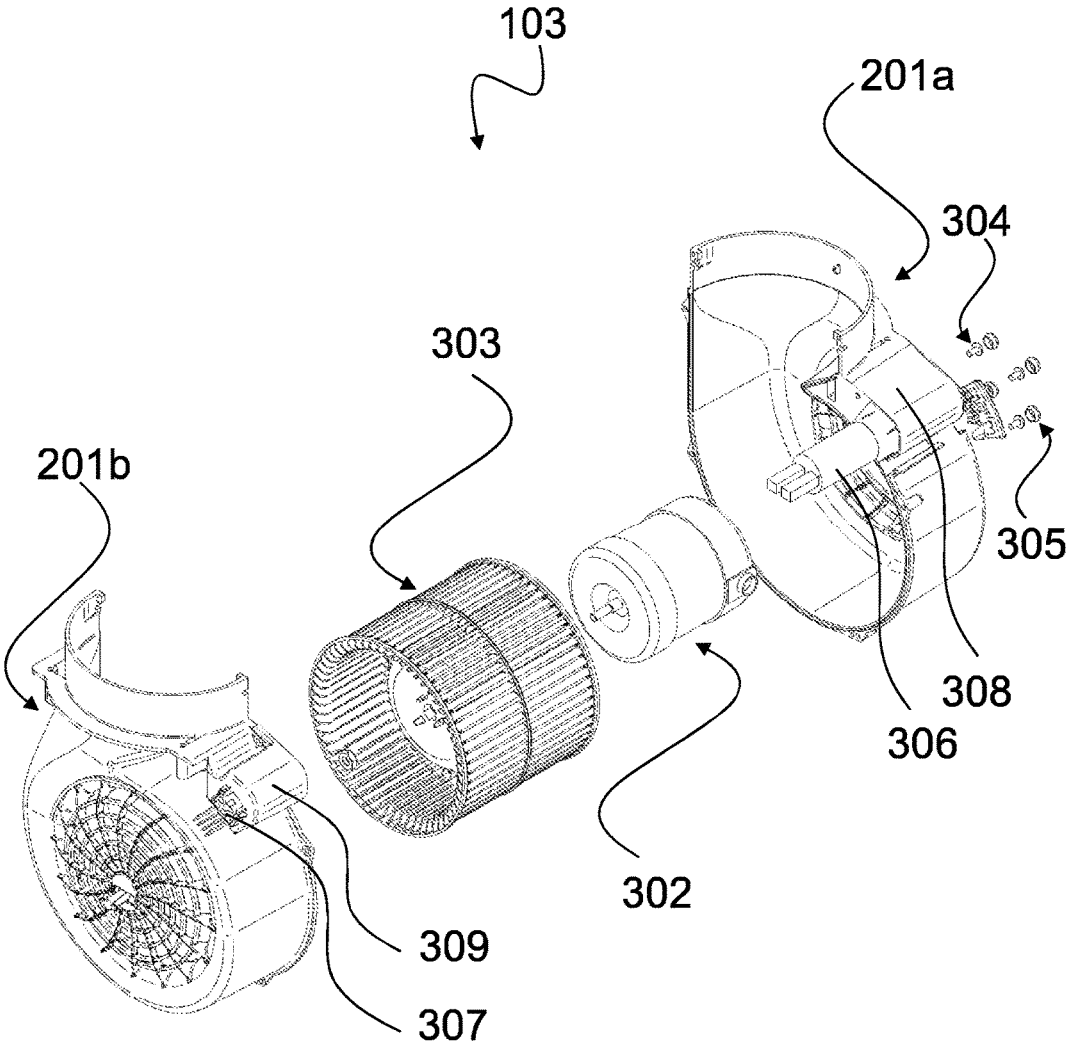
FIG. 3 shows how the suction device of the present invention is assembled.

FIG. 3 shows the assembly of a preferred embodiment of the suction device 103.

The suction device 103 comprises a volute 201, which is made up of two semi-shells 201*a* and 201*b* configured to be joined together. In particular, the semi-shells 201*a* and 201*b* are made by moulding of plastic material. For example, the semi-shells 201*a* and 201*b* are made of polypropylene.

The semi-shells 201*a* and 201*b* constitute the structure of the volute 201 and house an electric motor 302 and an impeller 303.

The electric motor 302 is adapted to drive the impeller 303, which is constrained at its own axis of rotation; as it rotates, the impeller 303 draws air into the volute 201 and directs it into the outflow collar 203.

In general, the impeller 303 of the suction device 103 can be designed in many ways understandable by those skilled in the art, in particular as regards the field of centrifugal fans with axial intake.

In the preferred embodiment, the electric motor 302 has a substantially cylindrical shape. According to a particularly preferred embodiment of the electric motor 302, said motor is a so-called "S-type" motor.

The electric motor 302 is of the type that requires a capacitor for receiving electric power, as will be further described below.

The motor 302 is inserted in the volute 201, in particular constrained to the semi-shell 201*a* by means of screws 304 fitted into suitable holes in the semi-shell 201*a*, which engage into respective threaded holes (not shown) of the motor 302.

In addition, the suction device 103 comprises covering elements such as plugs 305, which electrically insulate the screws 304 against accidental contact outside the suction device 103.

The suction device 103 further comprises a capacitor 306 and a connector 307, electrically connected to the capacitor 306, for supplying power to the motor 302. Thus, through the connector 307, also the capacitor 306 is electrically connected to the motor 302 for supplying power thereto.

The capacitor 306 preferably has a substantially cylindrical shape and is housed in the compartment 308 formed in the semi-shell 201*a*.

The connector 307 is housed in the compartment 309 formed in the semi-shell 201*b*.

The electric wiring between the motor 302 and the connector 307 is not shown in the drawings for the sake of clarity; the drawings can be easily interpreted by those skilled in the art even in the absence of such electric connection elements.

Preferably, the compartment 308 and the compartment 309 are formed in one piece, by moulding, in the same semi-shells 201*a* and 201*b*, respectively.

As will become apparent when comparing FIG. 2, which shows the suction device 103 in the assembled configuration, with FIG. 3, which shows the suction device 103 in the disassembled configuration, the compartments 308 and 309 are configured to be adjacent to each other in the assembled volute 201.

In particular, the compartments 308 and 309 are located externally to the volute 201, in particular with respect to the impeller 303 and also, in particular, to the motor 302.

Preferably, the compartments 308 and 309 are located proximal to the outflow collar 203, above the level of the motor 302, when the suction device 103 is in the position shown.

In particular, the volute 201 has an asymmetry dictated by the direction of rotation of the impeller 303, and the compartments 308 and 309 are located on the side of the volute which is left available by the collar 203 because of such asymmetry, thus occupying less room, resulting in a more compact suction device 103.

The compartment 308 comprises, in particular, just one aperture, visible in FIG. 3, while it has a blind bottom on the other side, visible in FIG. 2.

Figure 4:
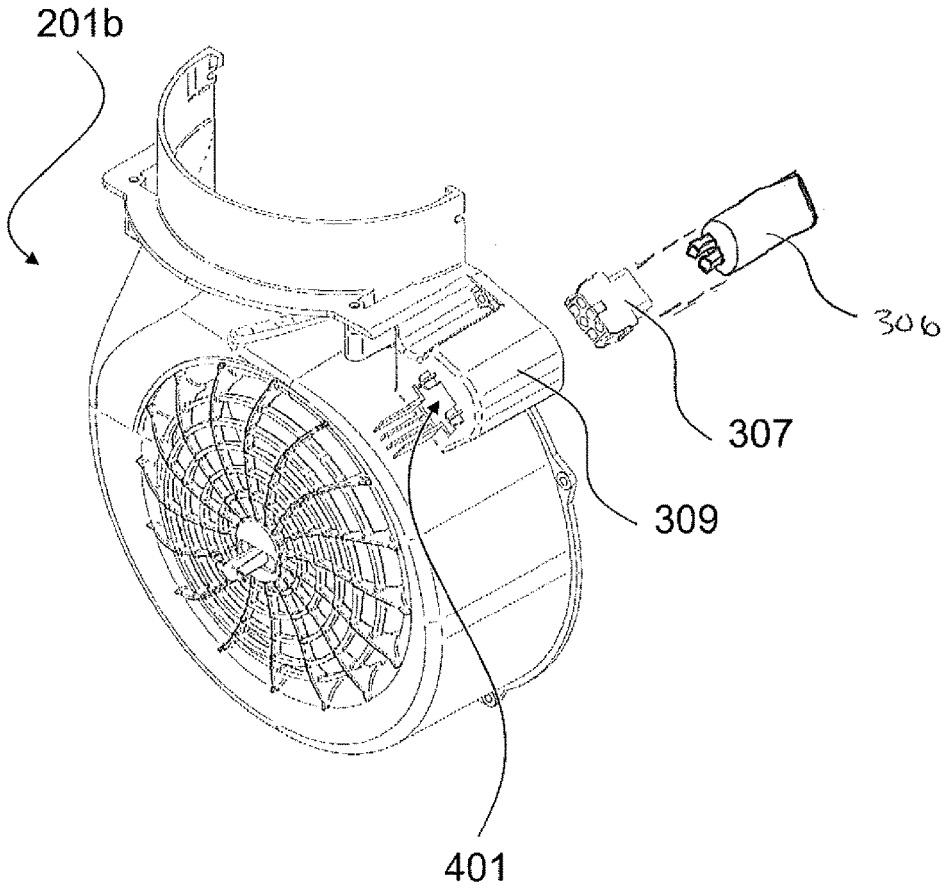
FIG. 4 shows in detail a connector housed in one of the two semi-shells of the volute.

The aperture of the compartment 308 faces a respective aperture of the compartment 309, hidden at the back of the semi-shell 201*b* in FIG. 4, so that, when the semi-shells 201*a* and 201*b* are joined together, a common casing is formed which houses the capacitor 306 on one side and the connector 307 on the other side.

The two semi-shells 201*a* and 201*b* are preferably joined to each other by means of a plurality of threaded junctions located at the adjacent edges.

In this manner, the compartment 308—once the volute 201 has been assembled—will be closed; therefore, the capacitor 306 can only be inserted through the single aperture available while assembling the suction device 103, when the semi-shells 201*a* and 201*b* are still separate. The capacitor 306 in the volute 201 will thus be insulated against accidental mechanical contact and out of the user's reach.

FIG. 4 shows in more detail the semi-shell 201*b*, in which the compartment 309 that houses the connector 307 is formed. For the sake of clarity, the connector 307 is shown in the drawing to be separate from the semi-shell 201*b*, thus exposing a second aperture 401 of the second compartment 309.

Said aperture 401 allows inserting the connector 307, which will be directly plugged onto the capacitor 306 inserted in the compartment 308. In this manner, the electric connection between the connector 307 and the capacitor 306 will be established directly and easily while assembling the suction device 103.

In fact, the aperture 401 allows inserting the connector 307 even when the suction device 103 has already been assembled, as shown by way of example in FIG. 2. Said aperture 401, in fact, will remain accessible even after the two semi-shells 201*a* and 201*b* have been joined together. The particular shape of the connector 307 allows it to be inserted into the aperture 401, since it is designed for resting against a suitable abutment surface visible in FIG. 4.

It is obvious that, in the light of the teachings of the present description, the man skilled in the art may conceive further variants of the present invention, without however departing from the protection scope as defined by the appended claims.

For example, the two compartments, respectively housing the capacitor and the connector, may be coupled together by means of suitable shape fittings other than the one shown herein.

Furthermore, the shape of the accessory elements of the volute of the suction device may be different than shown and described herein.

In general, the construction details provided merely by way of example in the present description can be modified by the man skilled in the art in accordance with prior-art teachings.

In particular, a suction device according to the present invention may use prior-art teachings as far as materials, construction details, equipment and accessory functions are concerned: all the general aspects of said suction device, whether or not described herein, may therefore vary, provided that they are not in conflict with the teachings of the present invention.

The invention claimed is:

1. A suction device for a hood, the suction device comprising:

an impeller;

an electric motor that drives said impeller;

a volute including a first semi-shell and a second semi-shell joined with each other so as to constitute a structure of said volute, wherein said volute has an interior that houses said electric motor and said impeller;

a capacitor inserted through a single aperture of a first compartment formed in said first semi-shell to house a portion of the capacitor in said first compartment; and a connector housed in a second compartment formed in said second semi-shell wherein said connector is detachably inserted through an exterior aperture of said second compartment to directly connect to said capacitor for supplying power to said electric motor when the first semi-shell and the second semi-shell are joined.

2. The suction device according to claim 1, wherein said first compartment and said second compartment are located externally to a portion of said volute that surrounds said impeller.

3. The suction device according to claim 1, further comprising an outflow collar, wherein said first compartment and said second compartment are located proximally to said outflow collar, above said electric motor.

4. The suction device according to claim 1, wherein said second compartment includes a first aperture and the external aperture in said second semi-shell, wherein said single aperture in said first semi-shell of said first compartment faces the first aperture of said second compartment when said first semi-shell and said second semi-shell are joined with each other, and wherein the single aperture of said first compartment and the first aperture of said second compartment form a casing for said connector and said capacitor.

5. The suction device according to claim 4, wherein the external aperture is accessible when said first semi-shell and said second semi-shell are joined with each other.

6. The suction device according to claim 5, wherein said capacitor is inserted through said single aperture of said first semi-shell when said first semi-shell and said second semi-shell are disengaged.

7. The suction device according to claim 1, wherein said first semi-shell and said second semi-shell are manufactured by molding of plastic material.

8. The suction device according to claim 7, wherein said first compartment and said second compartment are formed in one piece in said first semi-shell and in said second semi-shell, respectively.

9. The suction device according to claim 1, wherein said connector and said capacitor are inserted in said second compartment and in said first compartment, respectively, when the first semi-shell and the second semi-shell joined with each other.

10. A range hood, comprising:

a suction device that includes:

an impeller;

an electric motor that drives said impeller;

a volute including an interior that houses said electric motor and said impeller, wherein said volute includes a first semi-shell and a second semi-shell joined with each other so as to constitute a structure of said volute;

a capacitor inserted through a single aperture of a first compartment formed in said first semi-shell to house a portion of the capacitor in said first compartment;

a connector detachably inserted through an external aperture of a second compartment formed in said second semi-shell, wherein said connector is directly connected to said capacitor for supplying power to said electric motor, wherein said first compartment and said second compartment are adjacent to each other when the first semi-shell and the second semi-shell are joined; and an outflow collar, wherein said first compartment and said second compartment are located proximally to said outflow collar, above said electric motor.

11. The range hood according to claim 10, wherein said first compartment and said second compartment are located externally to a portion of the volute that surrounds said impeller.

12. The range hood according to claim 10, wherein said second compartment includes a first aperture and the external aperture in said second semi-shell, wherein said single aperture in said first semi-shell faces the first aperture of said second compartment when said first semi-shell and said second semi-shell are joined with each other, and wherein the single aperture of said first compartment and the first aperture of said second compartment form a casing for said connector and said capacitor.

13. The range hood according to claim 12, wherein the external aperture is accessible when said first semi-shell and said second semi-shell are joined with each other.

14. The range hood according to claim 13, wherein said capacitor is inserted through said single aperture of said first semi-shell when said first semi-shell and said second semi-shell are disengaged.

15. The range hood according to claim 10, wherein said first semi-shell and said second semi-shell are manufactured by molding of plastic material.

16. The range hood according to claim 15, wherein said first compartment and said second compartment are formed in one piece in said first semi-shell and in said second semi-shell, respectively.

17. The range hood according to claim 10, wherein said connector and said capacitor are inserted in said second compartment and in said first compartment, respectively, when the first semi-shell and the second semi-shell joined with each other.

18. The suction device according to claim 2, further comprising an outflow collar, wherein said first compartment and said second compartment are located proximally to said outflow collar, above said electric motor.

19. The suction device according to claim 2, wherein said second compartment includes a first aperture and the external second aperture in said second semi-shell, wherein said single aperture in said first semi-shell faces the first aperture of said second compartment when said first semi-shell and said second semi-shell are joined with each other, and wherein the single aperture of said first compartment and the first aperture of said second compartment form a casing for said connector and said capacitor.

20. A suction device for a hood, the suction device comprising:

an impeller;

an electric motor that drives said impeller;

a volute including a first semi-shell and a second semi-shell joined with each other so as to constitute a structure of said volute, wherein said volute has an interior that houses said electric motor and said impeller;

a capacitor inserted through a single aperture of a first compartment formed in said first semi-shell to house a portion of the capacitor in said first compartment; and a connector housed in a second compartment formed in said second semi-shell, wherein said connector is electrically connected to said capacitor by detachably engaging directly with said capacitor for supplying power to said electric motor, and wherein said first compartment and said second compartment are adjacent to each when the first semi-shell and the second semi-shell are joined.

* * * * *